US010804606B2

(12) United States Patent
Foo

(10) Patent No.: US 10,804,606 B2
(45) Date of Patent: Oct. 13, 2020

(54) BROADBAND LOW-BEAM-COUPLING DUAL-BEAM PHASED ARRAY

(71) Applicant: Huawei Technologies Co., Ltd., Shenzhen (CN)

(72) Inventor: Senglee Foo, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 357 days.

(21) Appl. No.: 15/639,808

(22) Filed: Jun. 30, 2017

(65) Prior Publication Data

US 2017/0324163 A1 Nov. 9, 2017

Related U.S. Application Data

(62) Division of application No. 14/041,754, filed on Sep. 30, 2013, now Pat. No. 9,711,853.

(Continued)

(51) Int. Cl.
*H01Q 5/22* (2015.01)
*H01Q 9/04* (2006.01)

(Continued)

(52) U.S. Cl.
CPC ..... *H01Q 5/22* (2015.01); *H01Q 1/246* (2013.01); *H01Q 3/28* (2013.01); *H01Q 3/30* (2013.01);

(Continued)

(58) Field of Classification Search
USPC ..... 342/368
See application file for complete search history.

(56) References Cited

U.S. PATENT DOCUMENTS 4,933,680 A 6/1990 Shapiro et al.
5,321,608 A 6/1994 Namba et al.

(Continued)

FOREIGN PATENT DOCUMENTS

CN 1507673 A 6/2004
CN 101895014 A 11/2010

(Continued)

OTHER PUBLICATIONS

Bugaj et al., Chapter 2, "Bandwidth Optimization of Aperture-Coupled Stacked Patch Antenna", http://dx.doi.org/10.5772/54661,@2013.

(Continued)

*Primary Examiner* — Frank J McGue
(74) *Attorney, Agent, or Firm* — Slater Matsil, LLP

(57) ABSTRACT

Broadband slot-coupled stacked patch antenna elements are capable of continuous broadband operation between 1.71 GHz and 2.69 GHz. The broadband slot-coupled stacked patch antenna element includes a mid-band radiating patch, a high-band radiating patch, and a low-band resonator with coupling slots capable of resonating at low, mid, and high band frequencies. Additionally, a low-profile probe-fed patch element is provided for pattern enhancement of antenna arrays at high-band frequencies. This low-profile patch element features fan-shaped probes that have three degrees of tune-ability, namely a length, a width, and a spreading angle. Further aspects include 3-column and 4-column offset arrays of the broadband patch radiators and an interleaved array of the low-profile high-band patch radiators and the broadband radiating elements. A new type of azimuth beam forming network (ABFN) is also introduced for the beam forming of the 3-column and 4-column dual-beam arrays.

21 Claims, 21 Drawing Sheets

Related U.S. Application Data

(60) Provisional application No. 61/863,203, filed on Aug. 7, 2013.

(51) Int. Cl.

| | |
|---|---|
| ***H01Q 1/24*** | (2006.01) |
| ***H01Q 21/06*** | (2006.01) |
| ***H01Q 21/24*** | (2006.01) |
| ***H01Q 3/28*** | (2006.01) |
| ***H01Q 3/30*** | (2006.01) |
| ***H01Q 19/10*** | (2006.01) |
| ***H01Q 5/40*** | (2015.01) |

(52) U.S. Cl.

CPC ..... *H01Q 5/40* (2015.01); *H01Q 9/045* (2013.01); *H01Q 9/0414* (2013.01); *H01Q 9/0457* (2013.01); *H01Q 19/10* (2013.01); *H01Q 21/065* (2013.01); *H01Q 21/24* (2013.01)

(56) References Cited

U.S. PATENT DOCUMENTS

| | | | | |
|---|---|---|---|---|
| 7,595,753 | B2 * | 9/2009 | Ratni | H01Q 3/2617 342/372 |
| 2003/0146872 | A1 | 8/2003 | Kellerman et al. | |
| 2004/0145526 | A1 | 7/2004 | Puente Baliarda et al. | |
| 2009/0128413 | A1 | 5/2009 | Crouch et al. | |
| 2010/0283707 | A1 | 11/2010 | Foo | |
| 2011/0279344 | A1 | 11/2011 | He et al. | |
| 2013/0156368 | A1 | 6/2013 | Hanjani | |
| 2014/0022123 | A1 | 1/2014 | Bruder et al. | |
| 2014/0375502 | A1 * | 12/2014 | Foo | H01Q 3/34 342/371 |
| 2015/0349425 | A1 * | 12/2015 | Kitchener | H01Q 13/18 343/860 |

FOREIGN PATENT DOCUMENTS

| | | | |
|---|---|---|---|
| CN | 102074779 | A | 5/2011 |
| CN | 102299409 | A | 12/2011 |
| CN | 102694247 | A | 9/2012 |
| EP | 1341259 | A1 | 9/2003 |

OTHER PUBLICATIONS

Foo, S., et al., "Adjustable Dual Beam Wireless Base Station Antenna," The Fourth International Conference on Wireless and Mobile Communications, Jul. 27, 2008-Aug. 1, 2008 pp. 315-320.

* cited by examiner

BROADBAND LOW-BEAM-COUPLING DUAL-BEAM PHASED ARRAY

This application is a divisional application of U.S. patent application Ser. No. 14/041,754 filed on Sep. 30, 2013 and entitled "Broadband Low-Beam-Coupling Dual-Beam Phased Array," which claims priority to U.S. Provisional Application No. 61/863,203 filed on Aug. 7, 2013, entitled "Broadband Low-Beam-Coupling Dual-Beam Phased Array," both of which are incorporated herein by reference as if reproduced in their entireties.

TECHNICAL FIELD

The present invention relates generally to wireless communications, and in particular embodiments, to a broadband low-beam-coupling dual-beam phased array.

BACKGROUND

Modern day wireless cellular antennas can emit a single or multiple beam signal. Single beam antennas emit a single beam signal pointing at the bore-sight direction of the antenna, while dual-beam antennas emit two asymmetric beam signals pointing in two different directions in opposite offset angles from the mechanical bore-sight of the antennas. In a fixed coverage cellular network, azimuth beam patterns of a dual-beam antenna are narrower than that of a single beam antenna. For example, a dual-beam antenna may emit two beams having a half power beam width (HPBW) of about thirty-three degrees in the azimuth direction, while a single beam antenna may emit one beam having a HPBW of about sixty-five degrees in the azimuth direction. The two narrow beams emitted by the dual-beam antenna may typically point in offset azimuth directions, e.g., plus and minus twenty degrees to minimize the beam coupling factor between the two beams and to provide 65 degree HPBW coverage in a three-sector network.

SUMMARY OF THE INVENTION

Technical advantages are generally achieved, by embodiments of this disclosure which describe a broadband low-beam-coupling dual-beam phased array.

In accordance with an embodiment, a broadband radiating element is provided. In this example, the broadband radiating element includes a low-band resonator mounted above an antenna reflector, a mid-band radiating patch mounted above the low-band resonator, and a high-band radiating patch mounted above the mid-band radiating patch. The low-band resonator is positioned between the mid-band radiating patch and the antenna reflector.

In accordance with another embodiment, a probe-fed patch radiating element is provided. In this example, the probe-fed patch radiating element includes a first printed circuit board (PCB) positioned below an antenna reflector, a second PCB positioned above the antenna reflector, a plurality of feed wires extending through the antenna reflector, and a radiating patch positioned above the second PCB. A plurality of microstrip feed-lines are printed on the first PCB, and a plurality of fan-shaped probes are printed on the second PCB. The plurality of feed wires conductively couple the microstrip feed-lines to the fan-shaped probes, and the radiating patch is electromagnetically coupled to the fan-shaped probes.

In accordance with yet another embodiment, an antenna is provided. In this example, the antenna includes an antenna reflector, a plurality of high-band radiating elements mounted to the antenna reflector, and a plurality of broadband radiating elements mounted to the antenna reflector. The plurality of high-band radiating elements are configured to radiate in a narrow high-band frequency, and the plurality of broadband radiating elements are configured to radiate in a wide frequency band that includes the narrow high-band frequency.

In accordance with yet another embodiment, yet another antenna is provided. In this example, the antenna includes an antenna reflector, and a plurality of broadband radiating elements mounted to the antenna reflector. The plurality of broadband radiating elements are arranged in a multi-column array comprising a first set of rows interleaved with a second set of rows. Broadband radiating elements in the first set of rows are horizontally shifted in relation to broadband elements in the second set of rows.

In accordance with yet another embodiment, an apparatus comprising an array of radiating elements and an azimuth beam forming network (ABFN) structure coupled to the array of radiating elements is provided. In this example, the ABFN structure is configured to receive a left-hand beam and a right-hand beam, to apply three or more arbitrary amplitude shifts to duplicates of the left-hand beam to obtain at least three or more amplitude-shifted left-hand beams, and to apply three or more arbitrary phase shifts to duplicates of the right-hand beam to obtain three or more phase-shifted right-hand beams. The AFBN structure is further configured to mix the three or more phase-shifted right-hand beams with respective ones of the three or more amplitude-shifted left-hand beams to obtain three or more mixed signals, and to forward duplicates of the three or more mixed signals to respective radiating elements in odd rows of the array of radiating elements. The AFBM structure is further configured to adjust a pre-tilt angle to duplicates of the three or more mixed signals to obtain three or more pre-tilt angle adjusted signals, and to forward the three or more pre-tilt angle adjusted signals to respective radiating elements in even rows of the array of radiating elements.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of embodiments of this disclosure are discussed in detail below. It should be appreciated, however, that the concepts disclosed herein can be embodied in a wide variety of specific contexts, and that the specific embodiments discussed herein are merely illustrative and do not serve to limit the scope of the claims. Further, it should be understood that various changes, substitutions and alterations can be made herein without departing from the spirit and scope of this disclosure as defined by the appended claims.

Base station antennas often use arrays of antenna elements in order to achieve enhanced spatial selectivity (e.g., through beamforming) as well as higher spectral efficiency. Conventional dual-beam antenna arrays may be configured to perform transmissions over frequencies within a Universal Mobile Telecommunications System (UMTS) band (e.g., between 1.71 GHz and 2.17 GHz) and frequencies within a long term evolution (LTE) frequency band (e.g., between 2.49 GHz and 2.69 GHz), but not over frequencies encompassing both the UMTS and LTE bands (e.g., between 1710 MHz and 2690 MHz). Accordingly, mechanisms and techniques for providing antenna arrays capable of continuous broadband operation (e.g., between 1.7 GHz and 2.69 GHz) are desired.

Aspects of this disclosure provide broadband slot-coupled stacked patch antenna elements that are capable of continuous broadband operation between 1.71 GHz and 2.69 GHz. This broadband slot-coupled stacked patch antenna element includes a mid-band radiating patch, a high-band radiating patch, and a low-band resonator with coupling slots capable of resonating at low, mid, and high band frequencies. Aspects of this disclosure also provide a low-profile probe-fed patch element for pattern enhancement of the array at high-band frequencies. This low-profile patch element features fan-shaped probes that have three degrees of tuneability, namely a length, a width, and a spreading angle. Additional aspects of this disclosure provide 3-column and 4-column offset arrays of the broadband patch radiators and an interleaved array of the low-profile high-band patch radiators and broadband radiating elements.

Figure 1:
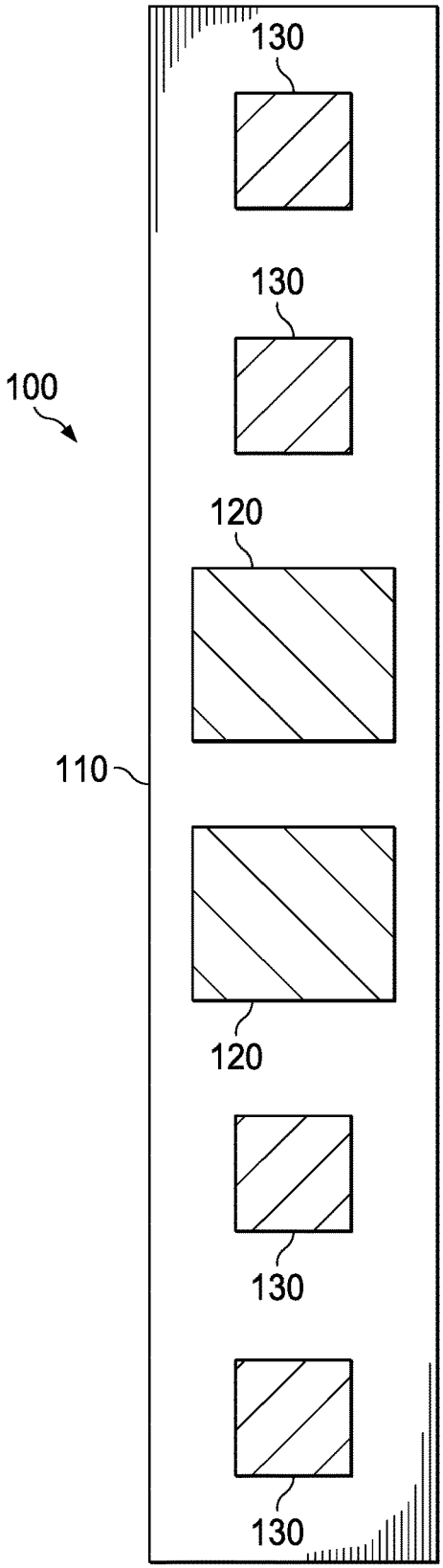
FIG. 1 (PRIOR ART)
FIG. 1 illustrates a diagram of a conventional dual-beam antenna array.

FIG. 1 illustrates a conventional dual-band antenna array 100 comprising a radome 110, a plurality of low-band radiating elements 120, and a plurality of high-band radiating elements 130. As shown, the low-band radiating elements 120 and the high-band radiating elements are arranged in a single column. Notably, the low-band radiating elements 120 are typically collocated and configured to radiate in a different frequency band than the high-band radiating elements 130. Also, high-band radiators are typically superimposed with the low-band radiators at locations where signals of both bands must be radiated at co-locations.

Figure 2:
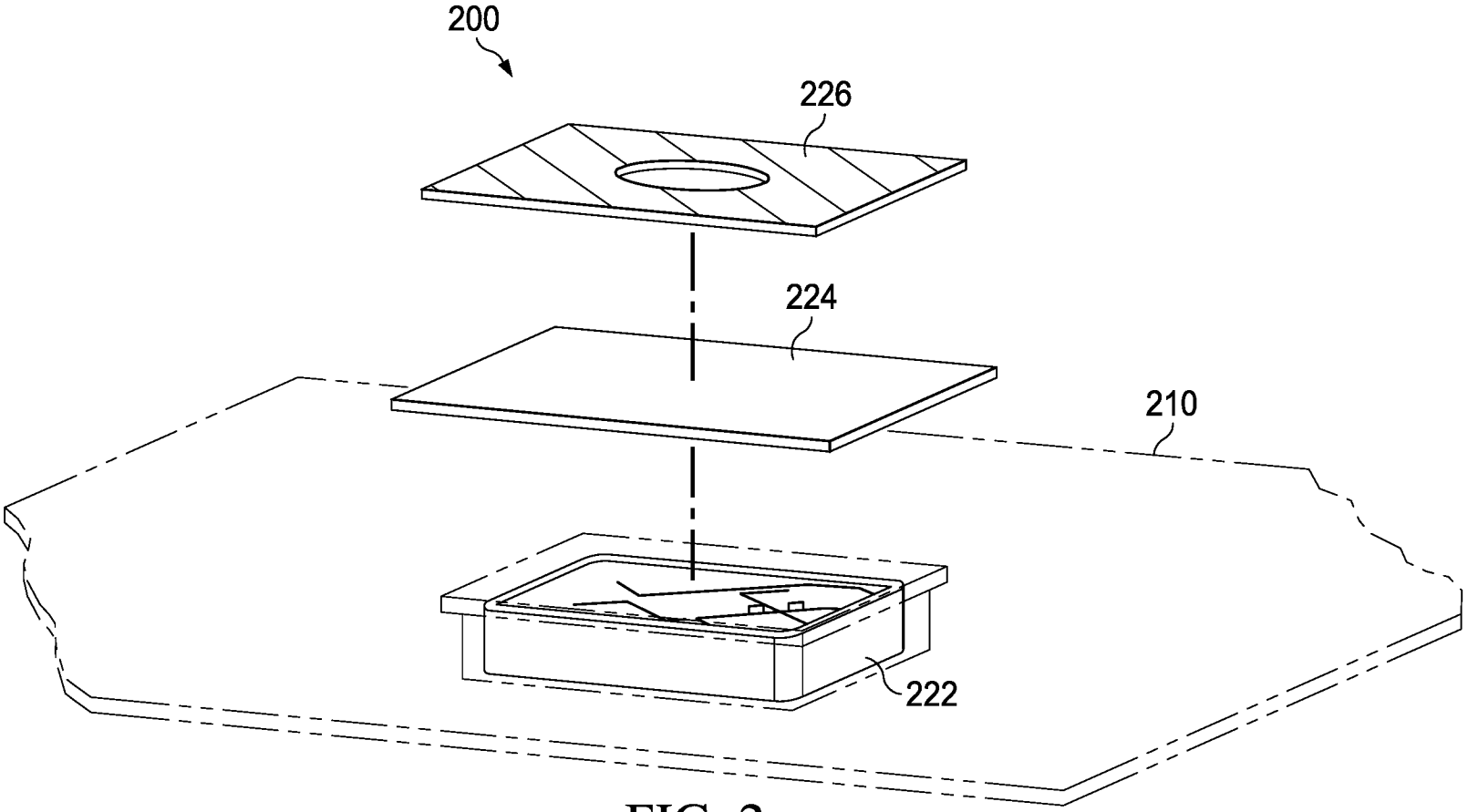
FIG. 2 (PRIOR ART)
FIG. 2 illustrates a diagram of a conventional low-band radiating element.
Figure 3:
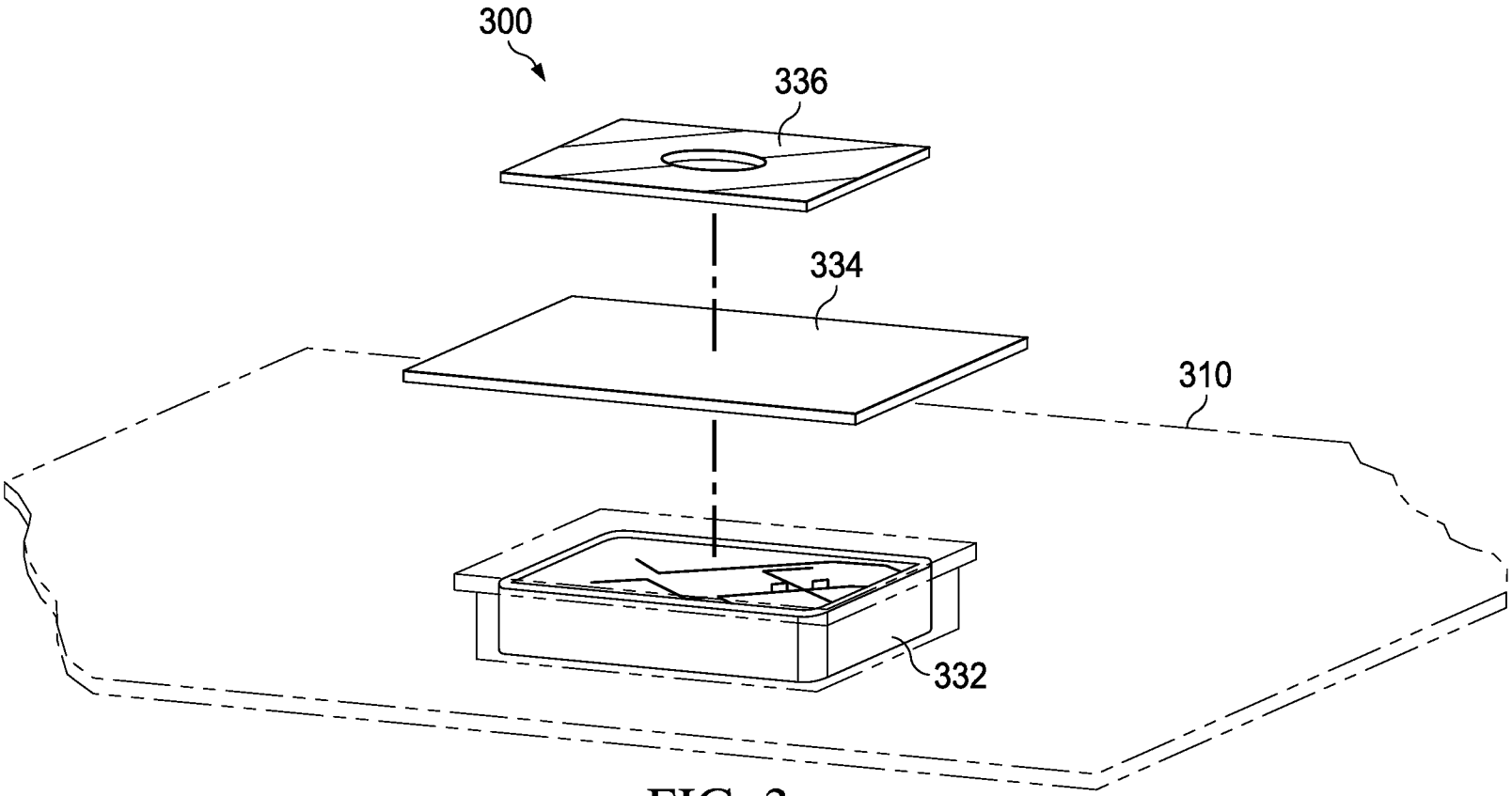
FIG. 3 (PRIOR ART)
FIG. 3 illustrates a diagram of a conventional high-band radiating element.

FIG. 2 illustrates a conventional low-band radiating element 200 mounted to an antenna reflector 210. The low band radiating element 200 comprises a back cavity 222, a printed circuit board (PCB) 224, and a low-band radiating element 226. The back cavity 222 houses active antenna components, and the PCB 224 includes interconnections for allowing the active antenna components to drive the low-band radiating element 226. FIG. 3 illustrates a conventional high-band radiating element 300 having a structure that is similar to the conventional low-band radiating element 200. The conventional high-band radiating element 300 is mounted to an antenna reflector 310, and comprises a back cavity 332, a PCB 334, and a low-band radiating element 336 configured in a similar way to like components of the conventional low-band radiating element 200. Notably, the high-band radiating element 300 is configured to operate in a different frequency band than the low-band radiating element 200.

Figure 4A:
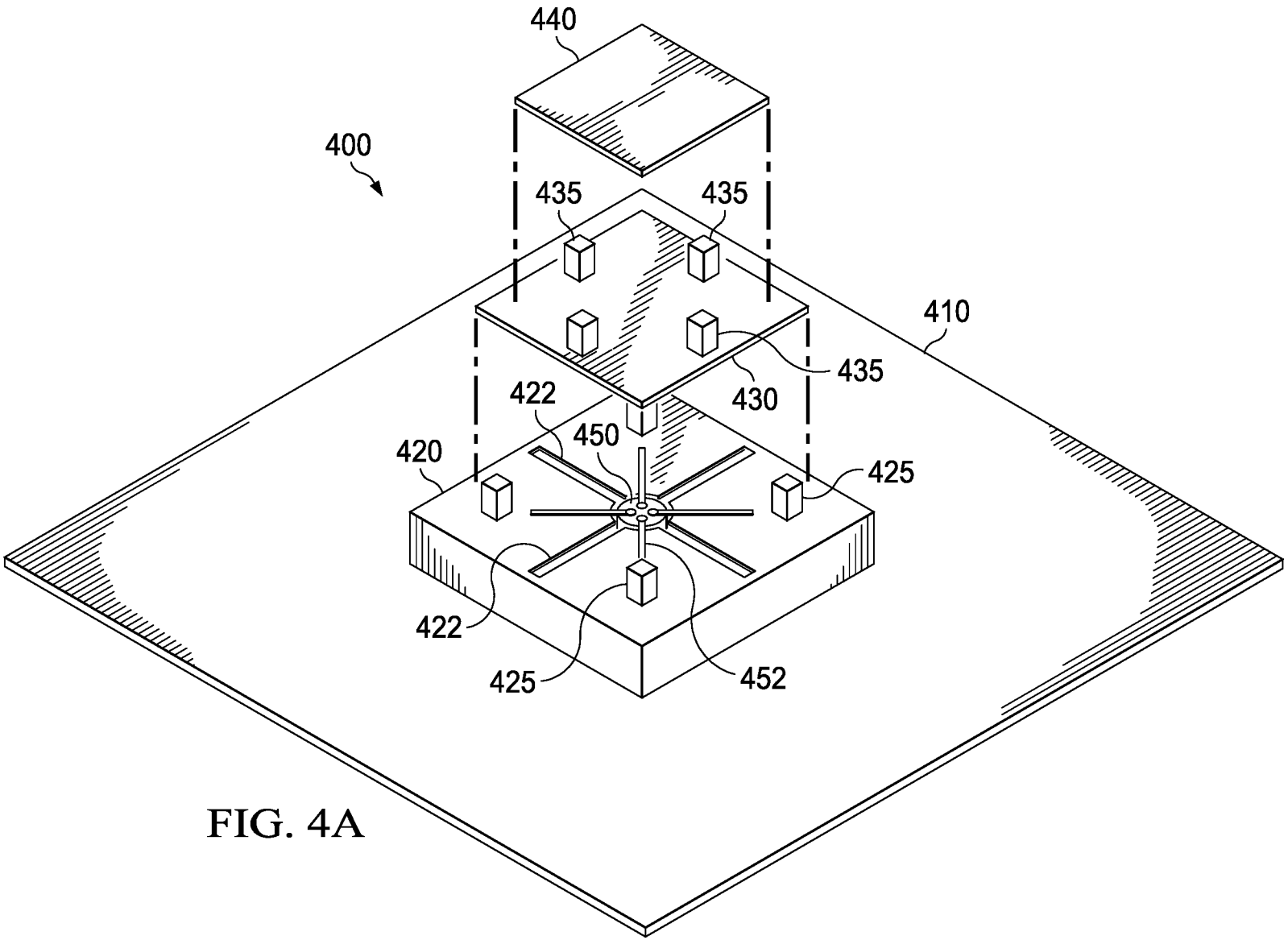
FIGS. 4A-4D illustrate diagrams of an embodiment broadband slot-coupled stacked patch element.
Figure 4B:
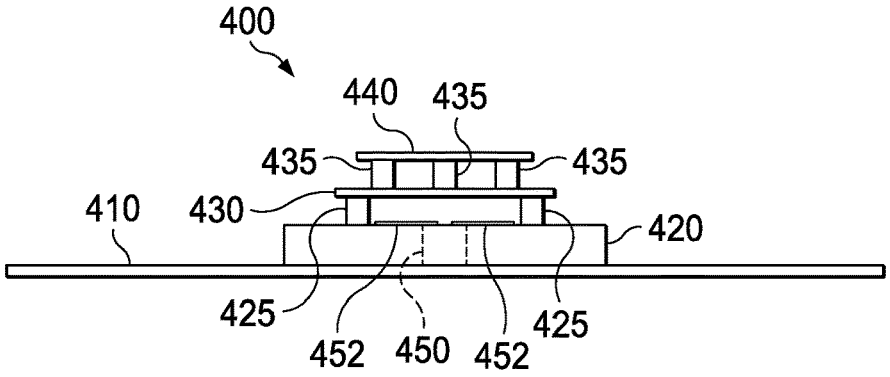
Figure 4C:
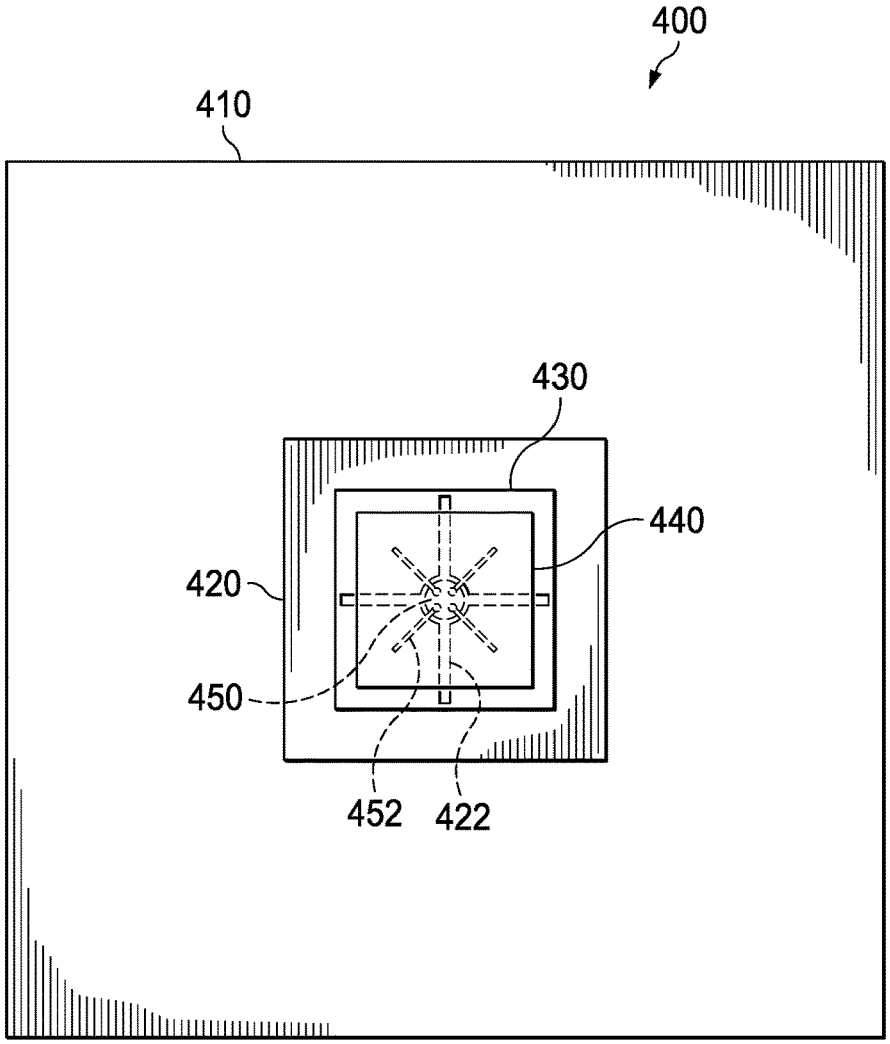
Figure 4D:
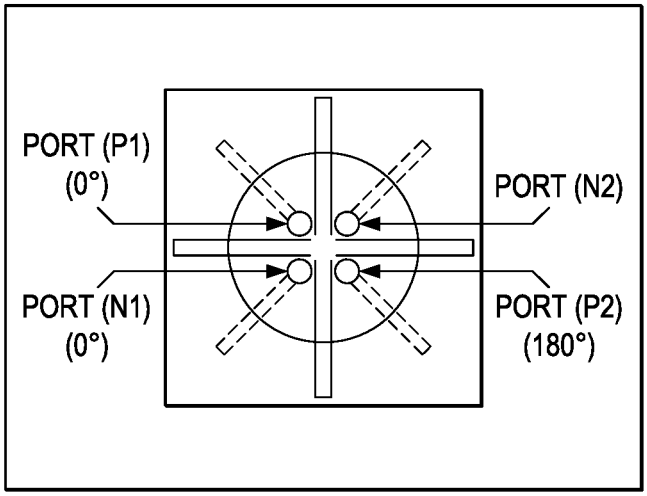

Aspects of this disclosure describe a broadband slot-coupled stacked patch radiating element that is configured to provide continuous broadband operation between 1.71 GHz and 2.69 GHz, providing a total signal bandwidth of over 45% with VSWR of 1.5:1. FIG. 4A illustrates an embodiment broadband slot-coupled stacked patch radiating element 400 mounted to an antenna reflector 410. As shown, the radiating element 400 comprises a low-band resonator 420, a low-band radiating patch 430, a high-band radiating patch 440, and a central feed 450. The low-band resonator 420 is positioned above the antenna reflector 410, and includes bent edges that serve to extend the signals radiated by the radiating patches 430, 440 to a low-frequency bandwidth. The mid-band radiating patch 430 is positioned above the low-band resonator 420, and the high-band radiating patch 440 is positioned above the mid-band radiating patch 430. Non-conductive spacers 425 are positioned between the low-band resonator 420 and the low-band radiating patch 430, and non-conductive spacers 435 are positioned between the high-band radiating patch 440 and the low-band radiating patch 440. Notably, the low-band resonator 420 includes cross-slots 422 and an opening through which the central feed 450 extends. The central feed 450 includes microstrip feedlines 452 which supply power to the radiating patches 430, 440. More specifically, the central feed 450 couples RF power from the PCB at the bottom of the reflector to the cross-slots, where power are electromagnetically coupled to both the mid-band radiating patch 430 and the high-band radiating patch 440 without being in physical contact with the radiating patches 430, 440. FIG. 4B illustrates a side view of the radiating element 400, while FIG. 4C illustrates a top view of the radiating element 400. The central feed 450 may include four center pins encased by a cylindrical tube, where the four center pins form short coaxes that carry RF signals from the PCB through the cross-slots to the radiating patches 430, 440. FIG. 4D shows typical excitation arrangement for the broadband slot-coupled stacked patch for dual linear polarization. The two cross slots are fed by four feed ports at the bottom PCB. For a linear positive 45° polarization operation, the two ports P1 and P2 are excited in equal amplitude with opposite phase (0° and 180°), while the other two ports N1 and N2 are excited in the similar fashion for linear negative 45° polarization operation. These two linear polarizations can be operating simultaneously.

Figure 5:
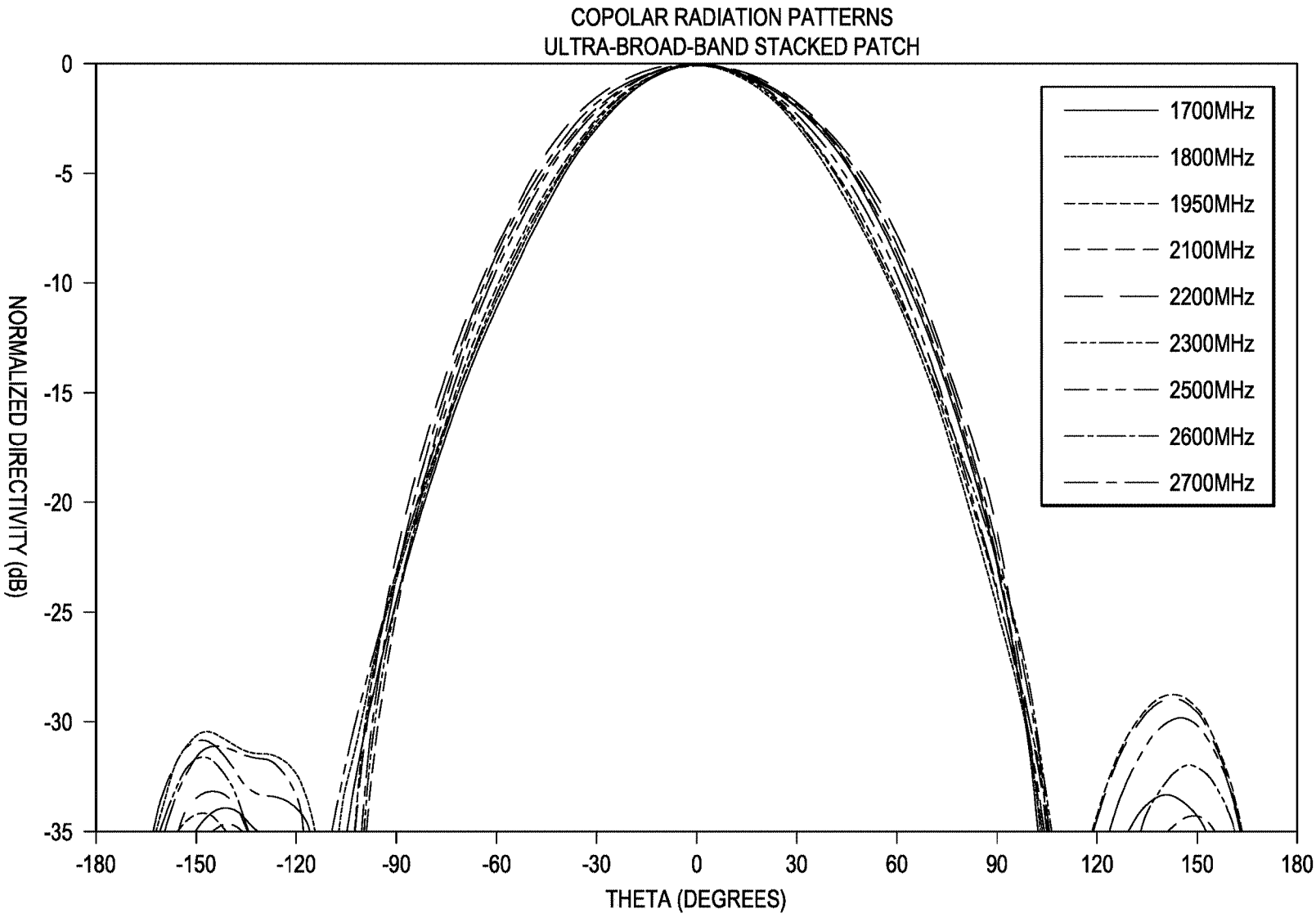
FIG. 5 illustrates a graph of radiation patterns produced by an embodiment broadband slot-coupled stacked patch element.
Figure 6:
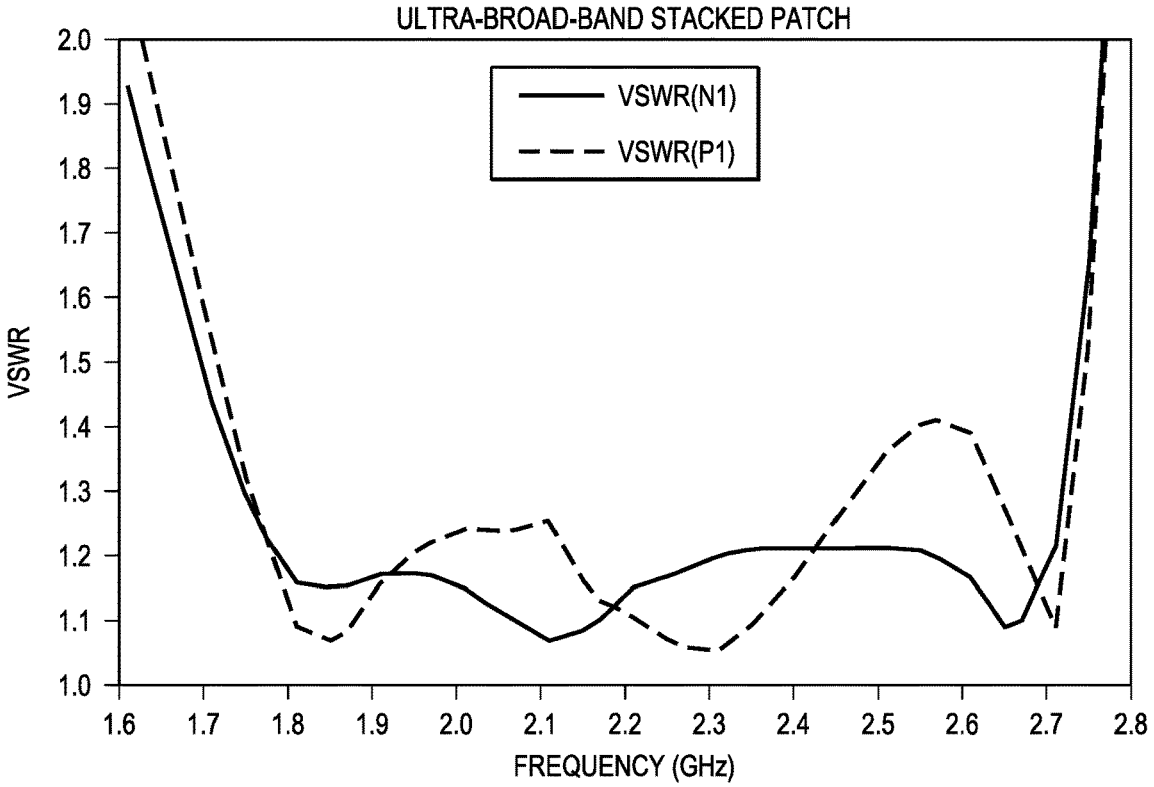
FIG. 6 illustrates a graph of voltage standing wave ratios (VSWRs) achieved by an embodiment broadband radiating element.
Figure 7:
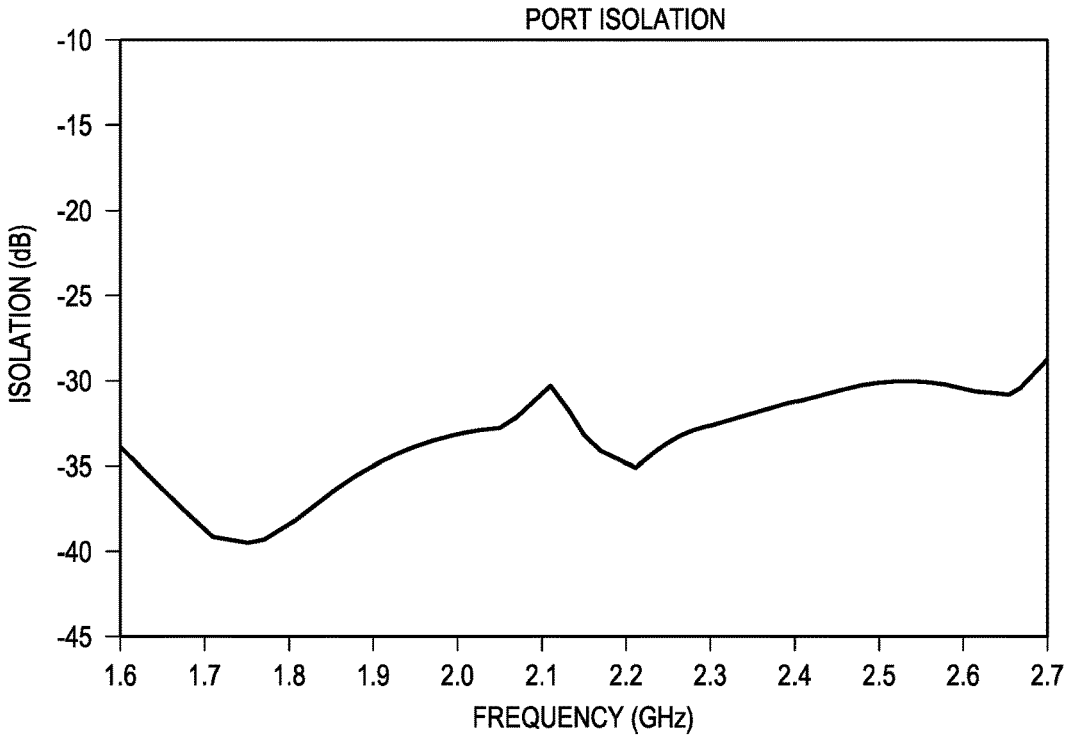
FIG. 7 illustrates a graph of port isolations achieved by an embodiment broadband radiating element.

FIG. 5 illustrates a graph of radiation patterns produced by the embodiment broadband radiating element 400. As shown, the embodiment broadband radiating element produces uniform radiation patterns across the various sample frequencies. FIG. 6 illustrates a graph of voltage standing wave ratios (VSWRs) achieved by the embodiment broadband radiating element 400. As shown, the embodiment broadband radiating element maintains a relatively low VSWR (e.g., below about 1.4) for much of the frequency spectrum ranging from about 1.7 GHz to 2.7 GHz. FIG. 7 illustrates a graph of port isolations achieved by the embodiment broadband radiating element 400. As shown, the embodiment broadband radiating element 400 maintains port isolation between the two polarization modes of less than 30 dB over much of the frequency spectrum ranging from about 1.7 GHz to 2.7 GHz.

Figure 8A:
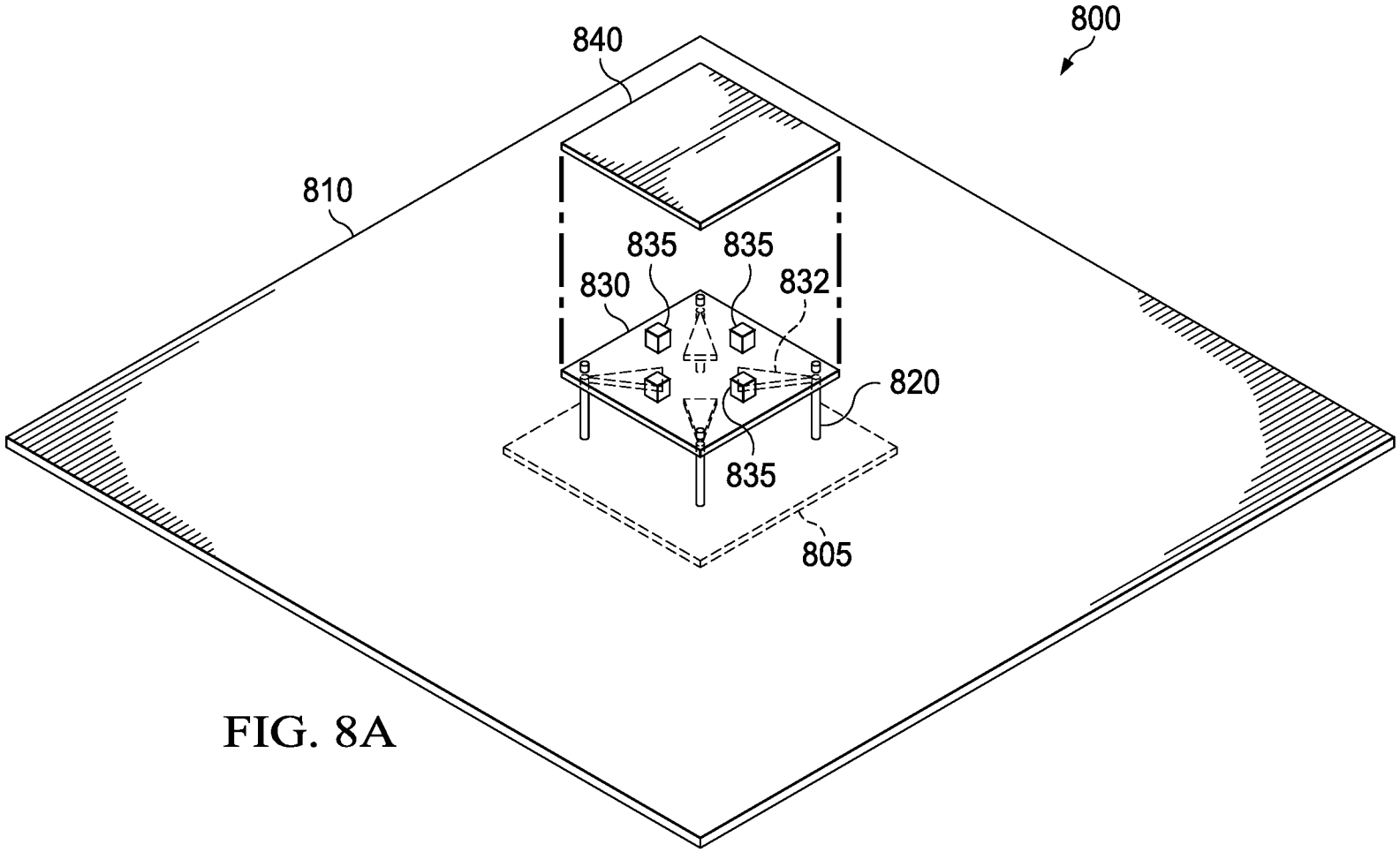
FIGS. 8A-8D illustrate diagrams of an embodiment low-profile probe-fed radiating element.
Figure 8B:
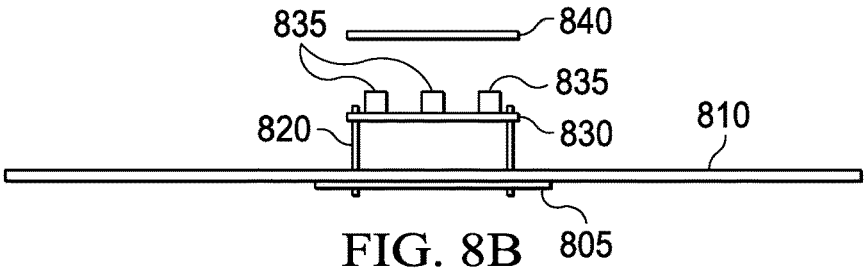
Figure 8C:
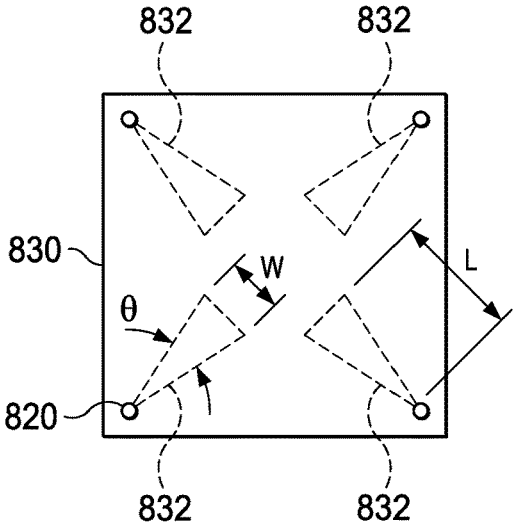
Figure 8D:
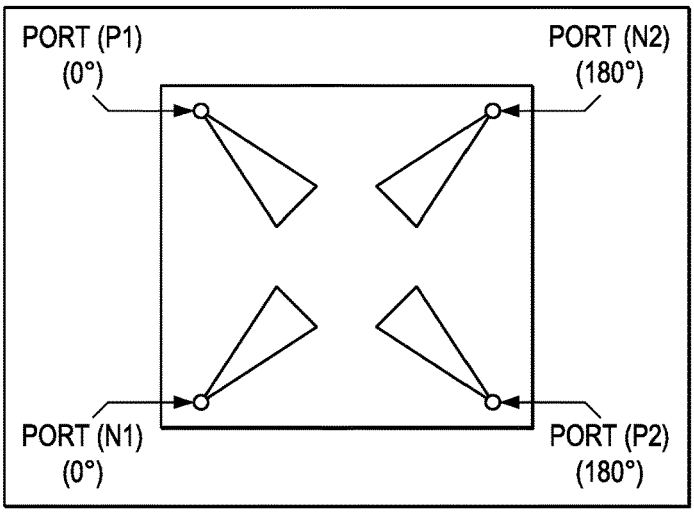

FIG. 8A illustrates an embodiment probe-fed patch element 800 mounted to an antenna reflector 810. As shown, the proposed probe-fed patch element 800 comprises a PCB 805, a plurality of feed wires 820, a PCB 830, and a radiating patch 840. The PCB 830 includes a plurality of fan probes 832, which are conductively coupled to microstrip feed lines in the PCB 805 by the feed wires 820. Signals from the fan probes 832 are then electromagnetically coupled to the radiating patch 840. In some embodiments, the radiating patch 840 is suspended above the surface of the PCB 830 by non-conductive spacers 835 such that the radiating patch 840 and the fan probes 832 are not in direct/physical contact. FIG. 8B illustrates a side view of the narrowband radiating element 800, while FIG. 8C illustrates a top view of the narrowband radiating element 800. As shown in FIG. 8C, the fan probes 832 extend inwards, towards the center of the PCB 830. Further, a width of the fan probes 832 increases as the fan probes 832 extend inwardly, thereby giving the fan probes 832 a fan-like shape. Notably, the fan-fed probes 832 offer enhanced tune-ability, as their dimensions (e.g., length (L), width (W), and spreading angle (θ)) can be manipulated to achieve different bandwidth characteristics. FIG. 8D shows typical excitation arrangement for the probe-fed patch for dual linear polarization. Each of the fan-shaped probes is fed by an independent port at the bottom PCB. For a linear positive 45° polarization operation, the two ports P1 and P2 are excited in equal amplitude with opposite phase (0° and 180°), while the other two ports N1 and N2 are excited in the similar fashion for linear negative 45° polarization operation. These two linear polarizations can be operating simultaneously. The probe-fed element 800 have a lower profile than embodiment broadband radiating elements provided by this disclosure. This difference in profile thickness reduces inter-band interference when both the high-band radiating elements 800 and embodiment broadband radiating elements are included in an antenna array configuration.

Figure 9:
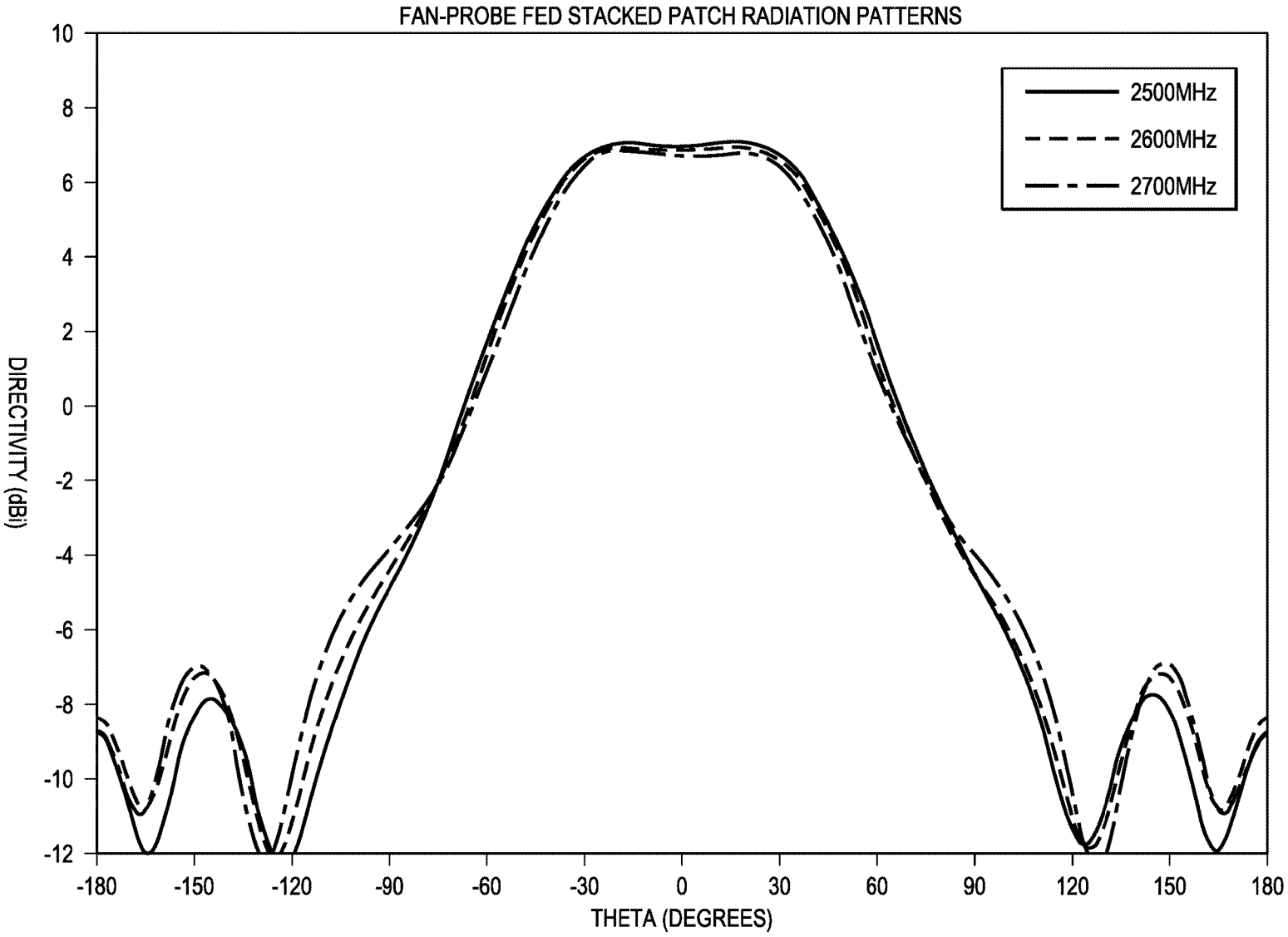
FIG. 9 illustrates a graph of radiation patterns produced by an embodiment low-profile probe-fed radiating element.

FIG. 9 illustrates a graph of radiation patterns produce by the embodiment narrowband radiating element 800. As shown, the embodiment narrowband radiating element 800 produces broad half power beamwidth (HPBW) across the various sample frequencies. Beam shapes having broad HPBWs may be desirable at high-band radiating frequencies, as they may tend to compensate for the narrower high band patterns produced by broadband arrays and therefore improve the overall coverage performance at high-band frequencies.

Figure 10:
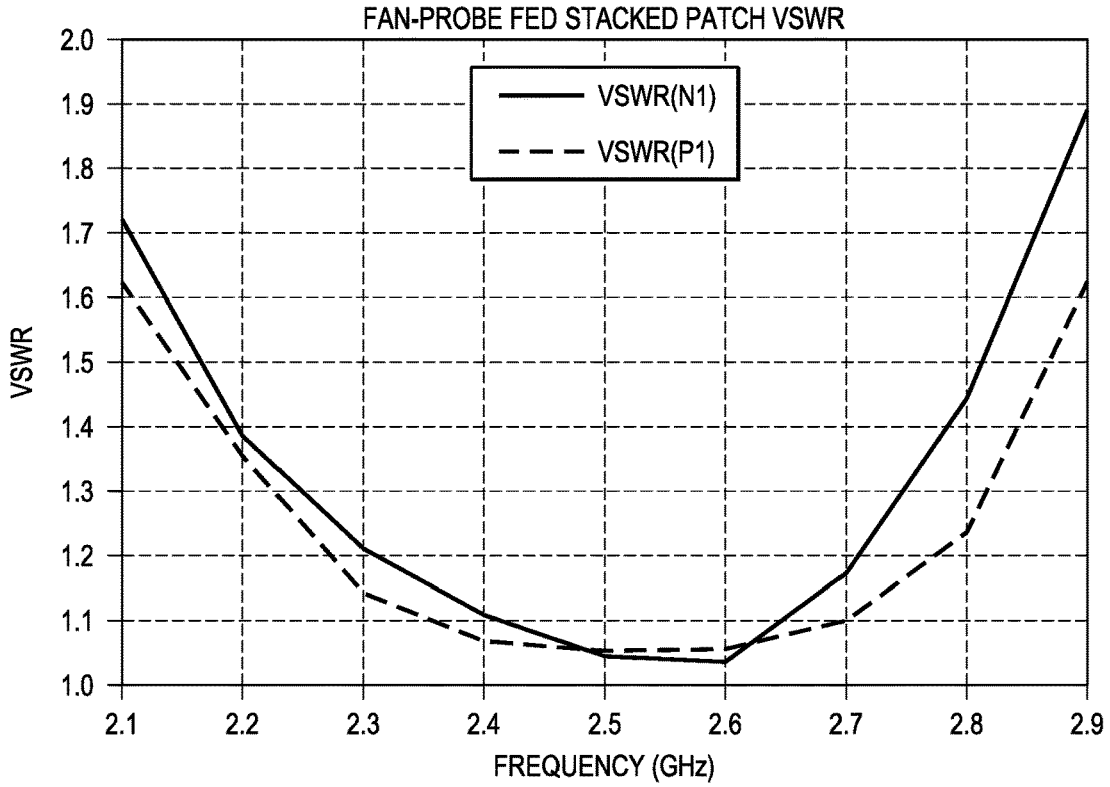
FIG. 10 illustrates a graph of voltage standing wave ratios (VSWRs) achieved by an embodiment low-profile probe-fed radiating element.
Figure 11:
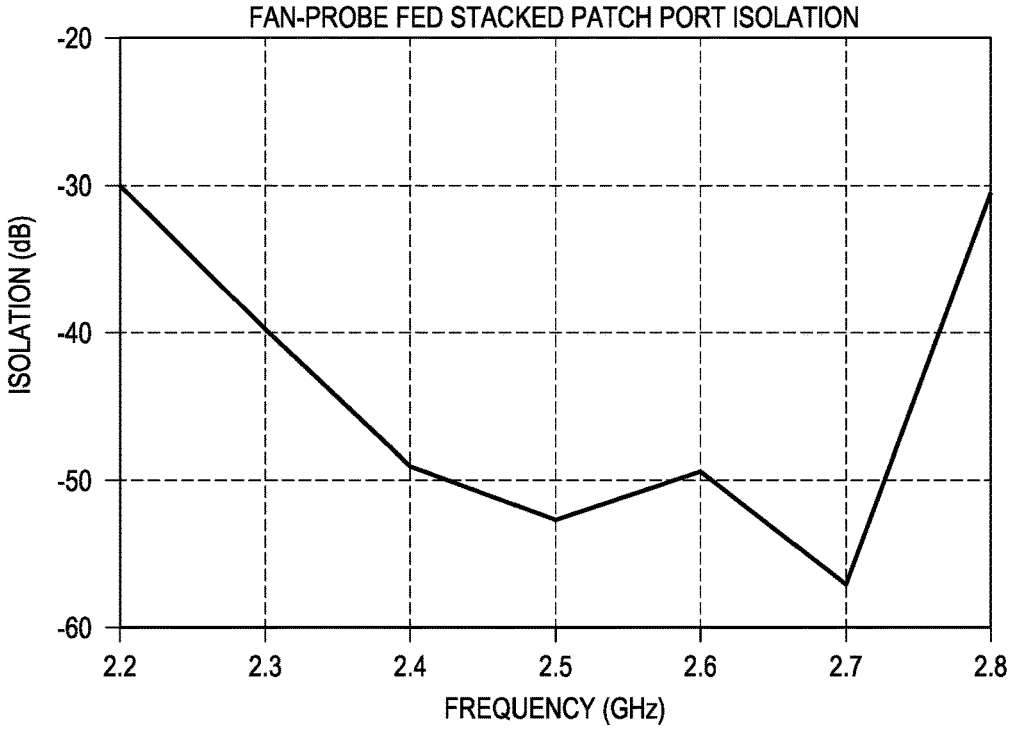
FIG. 11 illustrates a graph of port isolations achieved by an embodiment low-profile probe-fed radiating element.

FIG. 10 illustrates a graph of VSWRs achieved by the embodiment probe-fed element 800. As shown, the embodiment probe-fed element 800 maintains a relatively low VSWR (e.g., below about 1.4) for much of the frequency spectrum ranging from about 2.1 GHz to 2.9 GHz. FIG. 11 illustrates a graph of port isolation achieved by an embodiment narrowband radiating element. As shown, the embodiment narrowband radiating element maintains a port isolation between the two polarization modes of less than 30 dB over much of the frequency spectrum ranging from about 2.2 GHz to 2.8 GHz.

Figure 12A:
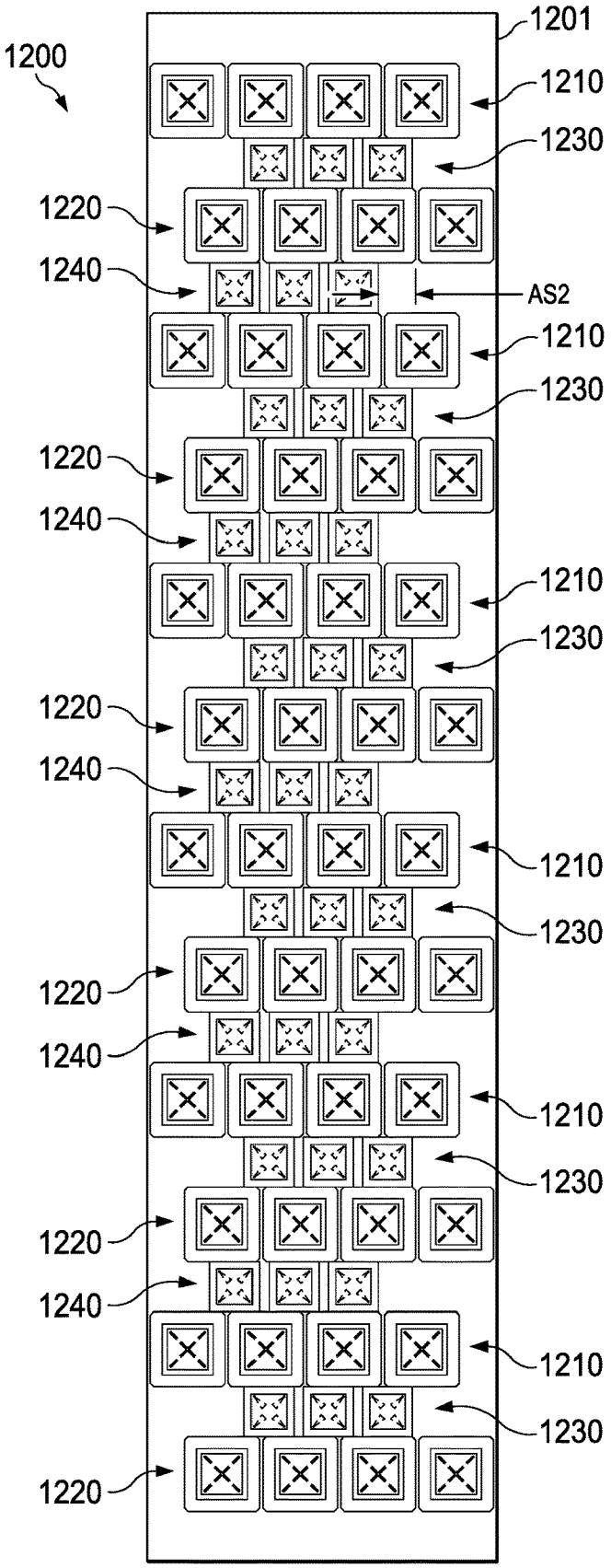
FIGS. 12A-12B illustrate diagrams of an embodiment broadband antenna array architecture.

FIG. 12A illustrates an embodiment broadband antenna array architecture 1200 comprising rows of broadband radiating elements 1210, 1220 interleaved with rows of high-band elements 1230, 1240. In some embodiments, the broadband radiating elements 1210, 1220 may be configured similarly to the embodiment broadband radiating element 400 described above, while the high-band elements 1230, 1240 may be configured similarly to the embodiment probe-fed element 800 described above.

Figure 12B:
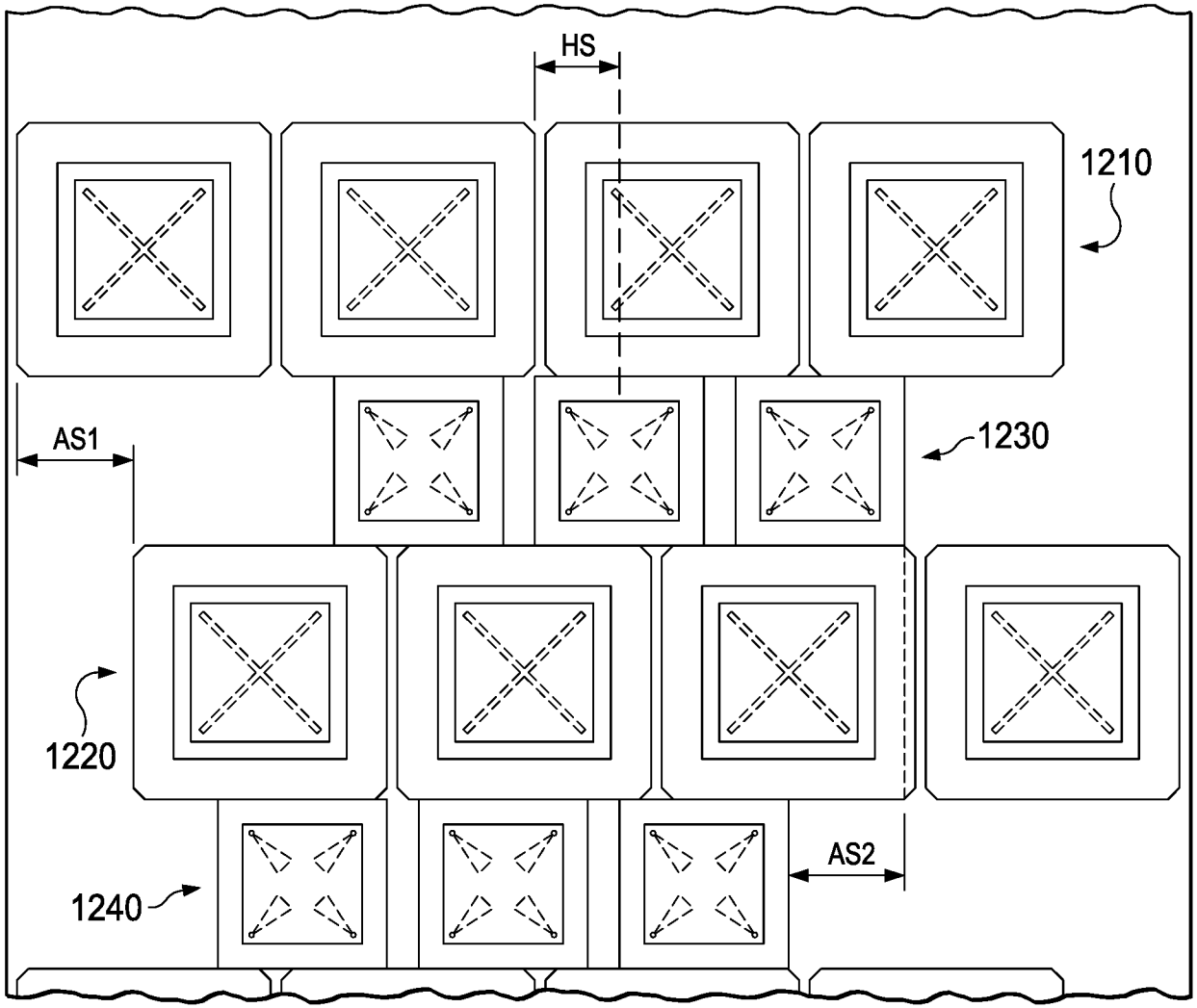
Figure 13A:
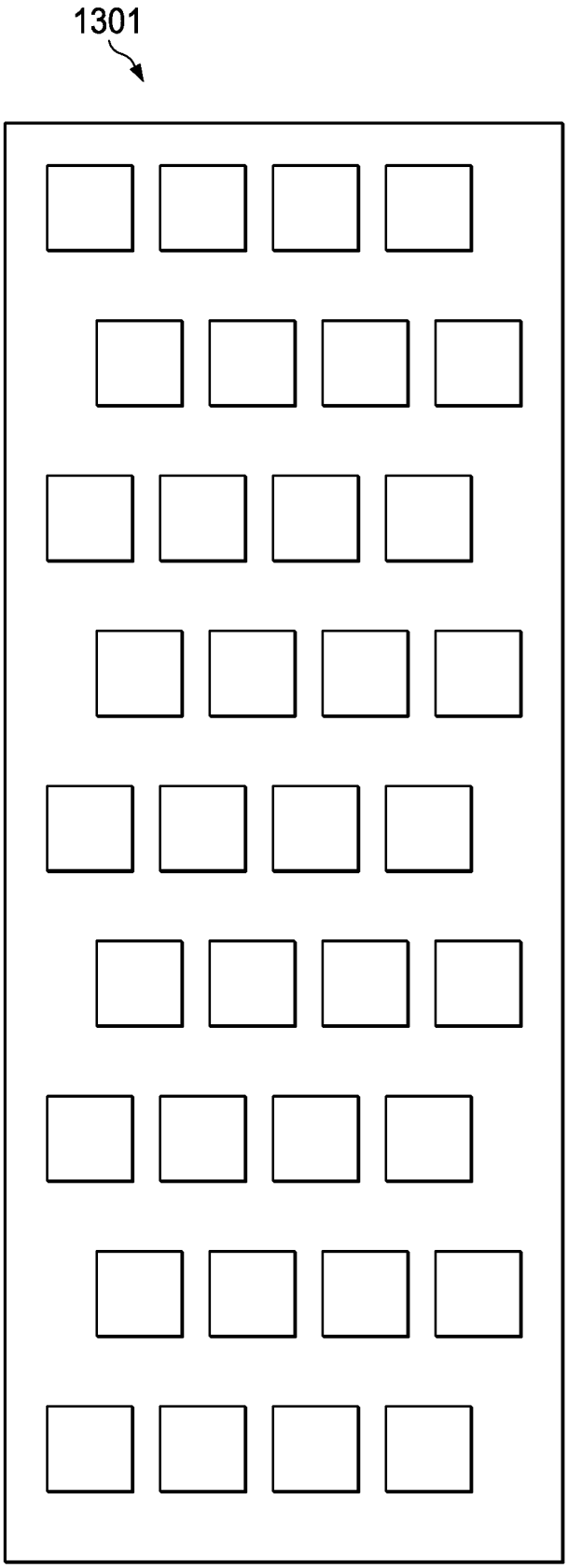
FIGS. 13A-13B illustrate diagrams of additional embodiment antenna array architectures.
Figure 13B:
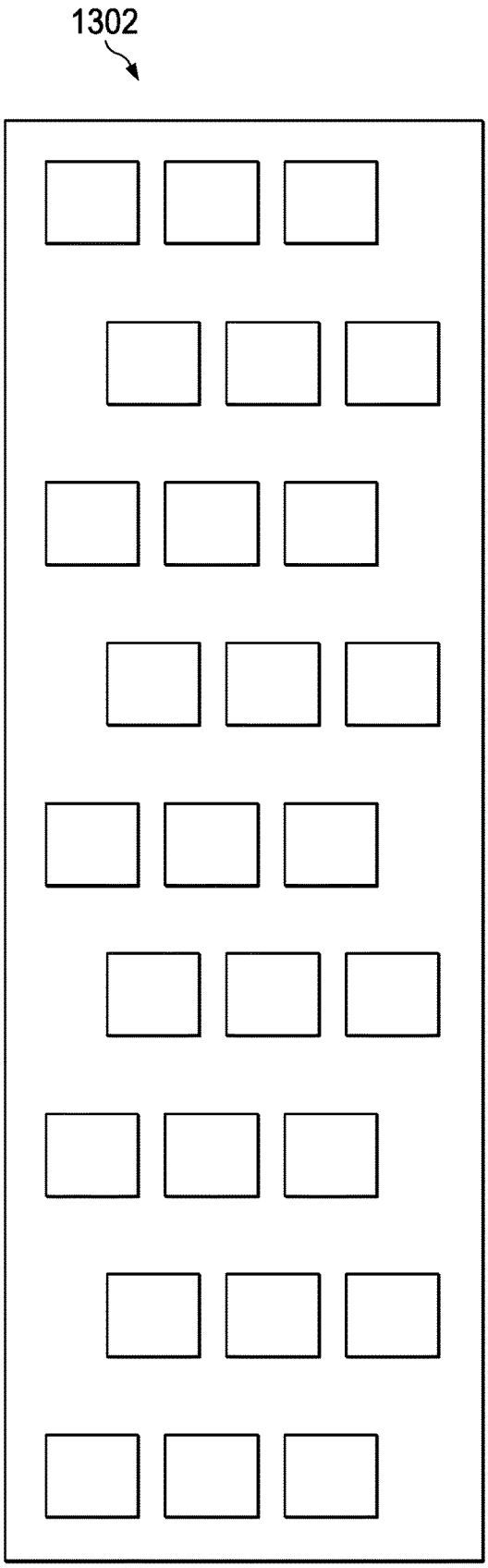

As show in FIG. 12B, the odd rows of high-band elements 1230 are horizontally shifted in relation to the even rows of high-band elements 1240, while the odd rows of broadband elements 1210 are horizontally shifted in relation to the even rows of broadband elements 1220. With proper amount, this horizontal shift (HS) allows reduction in radiation side-lobes in the azimuth plane without loss of directivity. Additionally, the high-band elements are also shifted in the horizontal direction with respect to the broadband elements to provide optimum horizontal patterns for the high-band signals. In cases where cost is the primary concern, the offset array can be constructed using only the broadband radiators without interleaving the high-band radiators. FIG. 13A illustrates an embodiment 4-column broadband offset array architecture 1301. FIG. 13B illustrates an embodiment 3-column broadband offset array architecture 1302. The offset architectures 1301 and 1302 may use broadband radiators.

In some embodiments, the embodiment broadband antenna arrays may achieve improved operation by including an element spacing that is approximately one-half wavelength in the azimuth direction and/or slightly over one-half wavelength in the elevation direction. For improved beam patterns across the a frequency band from 1710 MHz to 2690 MHz, an azimuth spacing of the broadband elements may be selected to optimize the low-band performance, while the azimuth spacing of the narrowband radiating elements is selected to optimize the high-band performance. The broadband radiators may be distributed in an offset four-column configuration for improved aperture efficiency. The lower-profile narrowband radiating elements can be inserted between the broadband arrays. In some embodiments, alternating rows of narrowband/broadband radiating elements are offset in the azimuth direction to achieve low side-lobe performance for high and low frequency bands. In this configuration, the azimuth beams are first formed for each sub-group of array consisting of two or more rows of the array, using tailor-made 4×2 or 3×2 azimuth beam forming network (ABFN). A multi-port variable phase shifters is then used to feed these ABFNs to complete formation of the 2-dimensional array.

Figure 14:
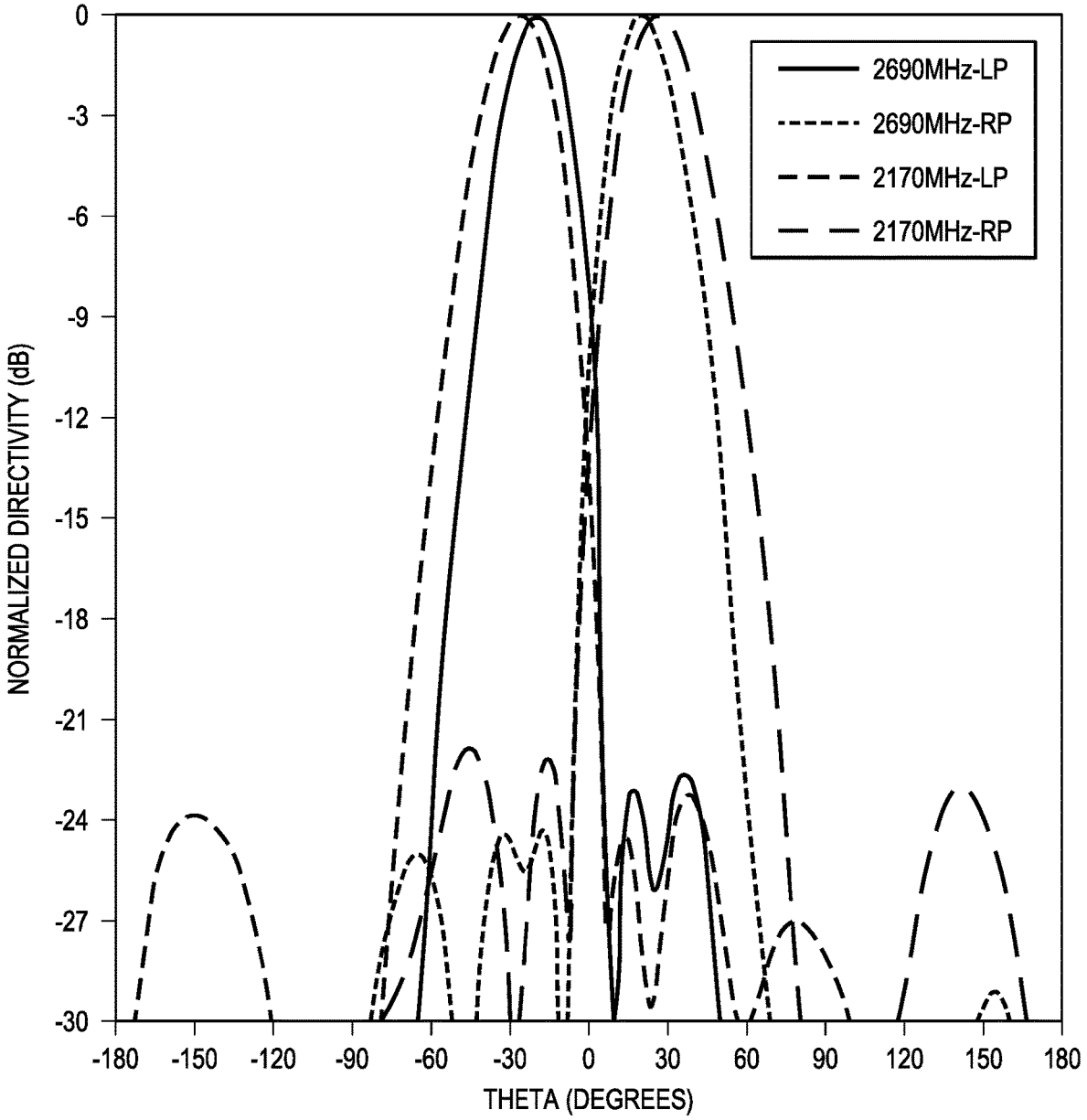
FIG. 14 illustrates a graph of an azimuth radiation pattern achieved by an embodiment broadband antenna array.

FIG. 14 illustrates an azimuth radiation pattern achieved by the embodiment broadband antenna array architecture 1200. In a dual-linearly polarized array, for each frequency of operation, there are four independent asymmetric beams: Left Positive 45° (LP), Right Positive 45° (RP), Left Negative 45° (LN) and Right Negative 45° (RN) beams. To encompass a typical 65° cell coverage, each of the dual-beam array provides azimuth beam patterns with an azimuth HPBW of approximately 33°. This way, the combined HPBW of the two beams can provide approximately the same coverage of a standard 65° beam. Beam shapes of the radiation patterns are carefully designed such that each component beam (left and right) are orthogonal to each other with very low beam coupling factor. The design parameters may be designed in accordance with the following formula: $\text{Min}\ (\beta_{RL})=\text{min}\ (k^*\int E_R(\theta,\Phi)\cdot E_L(\theta,\Phi)\ d\Omega)$, where k is normalization constant, $E_R(\theta,\Phi)$ represents the radiation pattern of the right beam, and $E_L(\theta,\Phi)$ represents the radiation pattern of the left beam. Low beam coupling factor, $\beta_{RL}$, implies highly orthogonal component beams, which is critical for the optimum network performance. Other typical features of these patterns include high roll-off rate at points where the two component beams intersect, low azimuth side lobes, beam cross-over −7 dB to −13 dB between patterns, good front to back ratio of typically over 30 dB in the back of the antenna. Through the virtue of orthogonality of the BFN and spectrum isolation between the two bands, the four asymmetric beams produced by the broadband BSA can be reduced to extremely low values. Therefore, this architecture results in significantly improved network performances without having the penalty of increasing the overall size of a base-station antenna.

Figure 15:
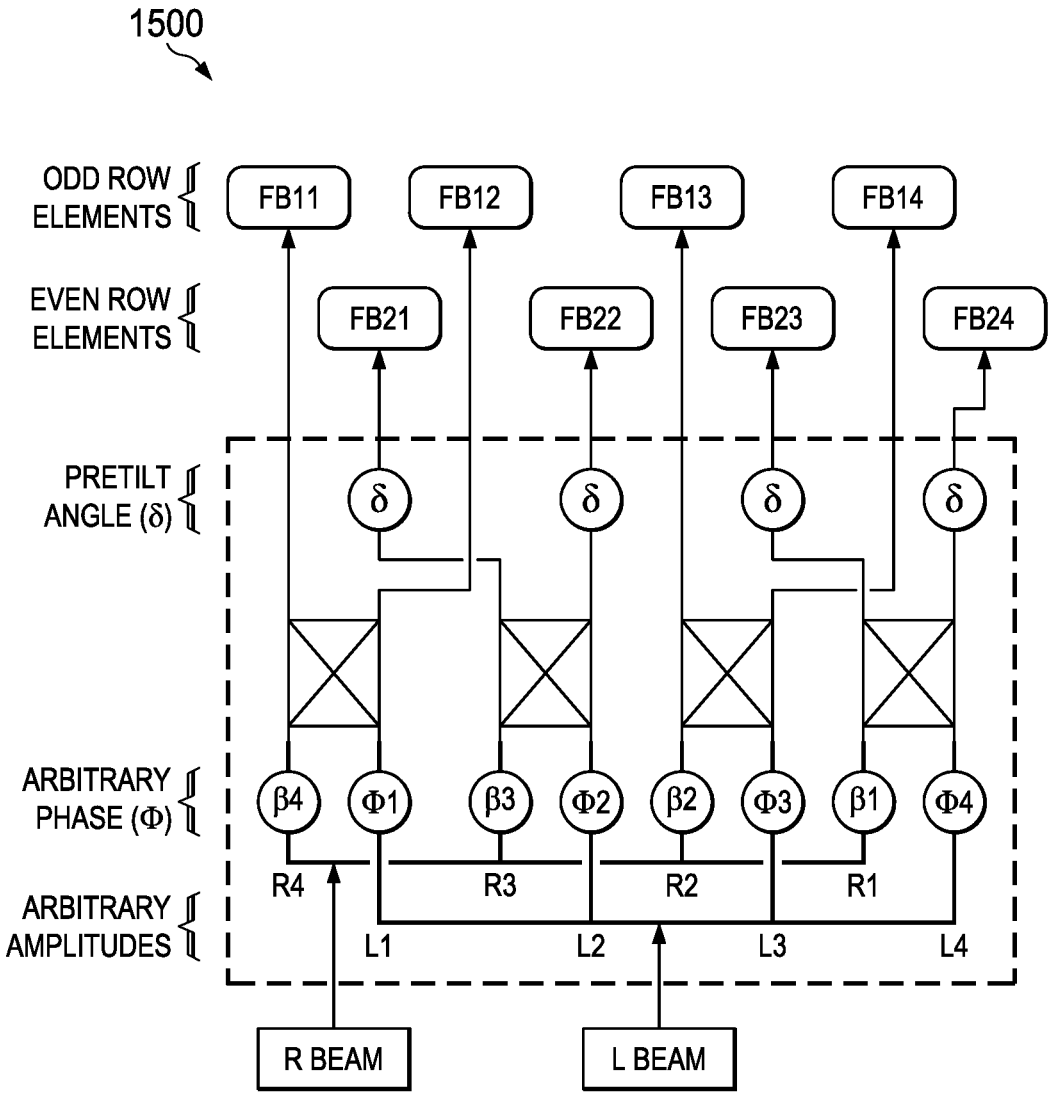
FIG. 15 illustrate diagrams of an embodiment horizontal-paring arbitrary function azimuth beam forming network (ABFN)
Figure 16A:
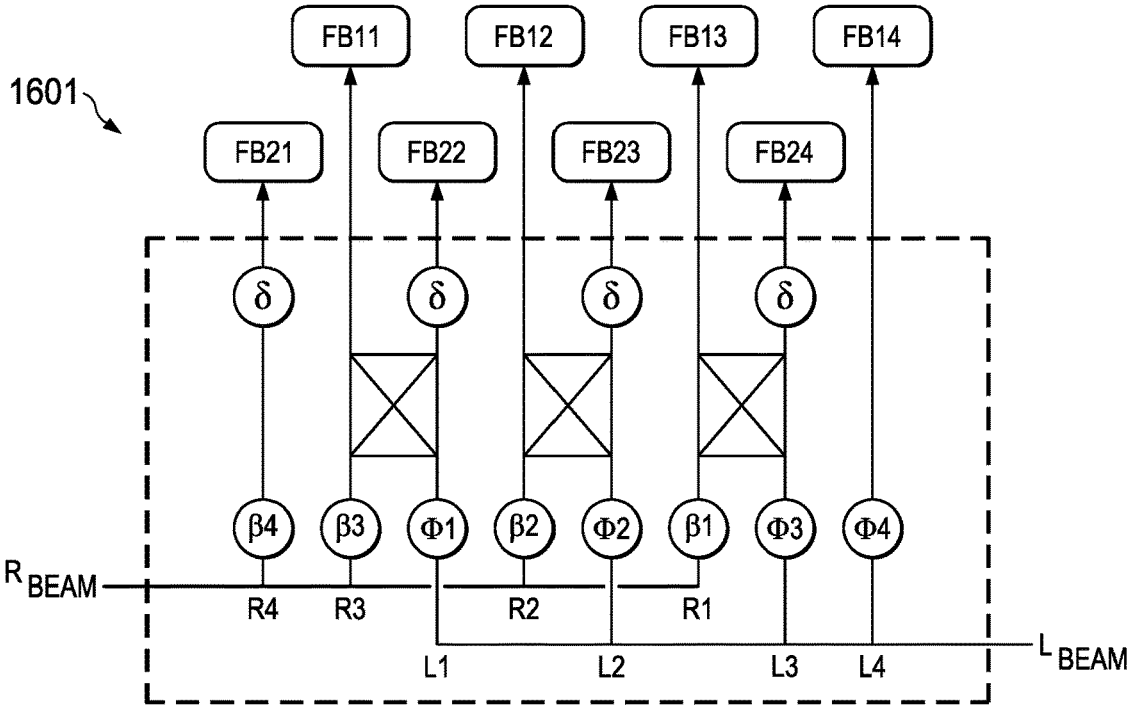
FIGS. 16A-16B illustrate diagrams of embodiment of vertical-pairing arbitrary function azimuth beam forming networks (ABFNs)
Figure 16B:
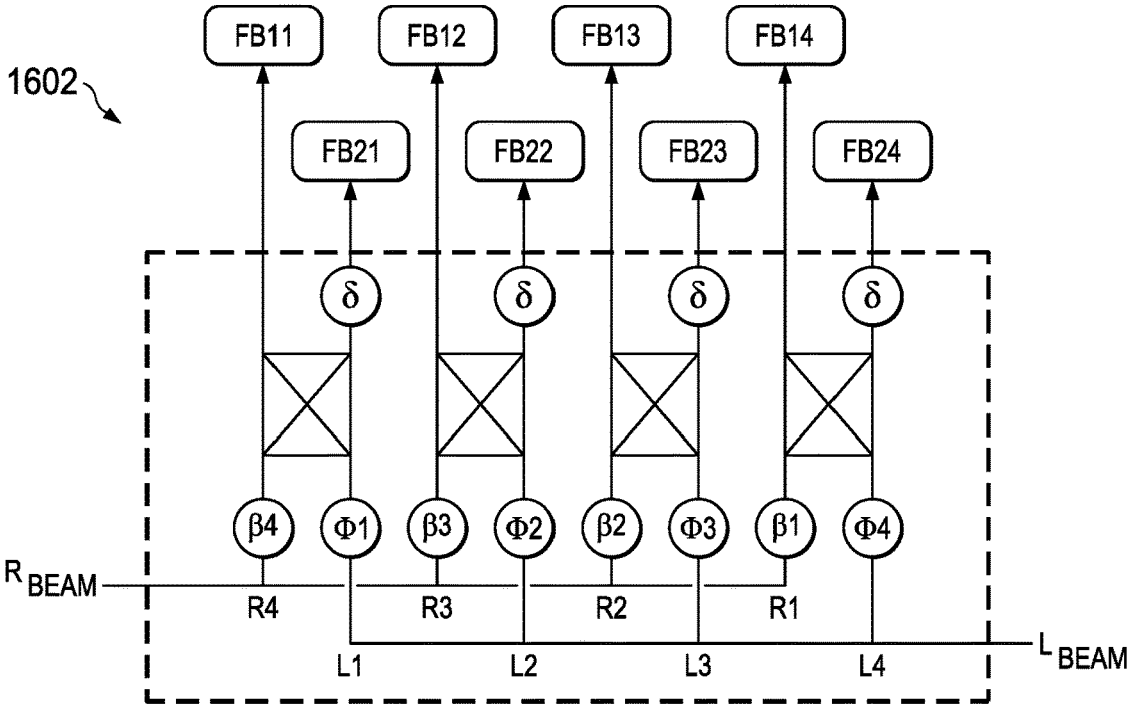

FIG. 15 illustrates an embodiment azimuth beam forming network (ABFNs) 1500 for a 4-column array. FIG. 16A illustrates an ABFN 1601 for 3-column array. FIG. 16B illustrates an ABFN 1602 for 4-column array. These ABFN configurations offer higher degrees of freedom on beam shaping and can achieve beam orthogonality as a result of flexibility on excitation weighting function. Compared to a Butler matrix and 3-column ABFN, the embodiment ABFNs 1500, 1601, 1602 offer more degree-of freedom in achieving pattern side-lobe levels and roll-off rate of beam shape in the azimuth direction. Table I and II give a typical azimuth excitation weight functions for the low-band (LB) and high-band (HB) beams, where the β represents the required azimuth phase offset angle between rows. For the Low-band operations, only the full-band elements are excited. For high-band operations, both the full-band and high-band radiators are excited according to the Table II.

TABLE 1

Low-band Az excitation weight function

| | | Left Beam (L) | | Right Beam (R) | |
|---|---|---|---|---|---|
| Array Element | ABFN Port | Amp (W) | Phase (deg) | Amp (W) | Phase (deg) |
| FB 11 | $(A_1, \Phi_1)$ | 0.5 | −180-β | 0.5 | 0 |
| FB 12 | $(A_2, \Phi_2)$ | 1 | −85-β | 1 | −85 |
| FB 13 | $(A_3, \Phi_3)$ | 0.5 | 0-β | 0.5 | −180 |
| FB 14 | $(A_5, \Phi_5)$ | 0.08 | +110-β | 0 | NA |
| FB 21 | $(A_4, \Phi_4)$ | 0 | NA | 0.08 | +110-β |
| FB 22 | $(A_1, \Phi_1)$ | 0.5 | −180 | 0.5 | 0-β |
| FB 23 | $(A_2, \Phi_2)$ | 1 | −85 | 1 | −85-β |
| FB 24 | $(A_3, \Phi_3)$ | 0.5 | 0 | 0.5 | −180-β |

TABLE 2

High-band Az excitation weight function

| | | Left Beam (L) | | Right Beam (R) | |
|---|---|---|---|---|---|
| Array Element | ABFN Port | Amp (W) | Phase (deg) | Amp (W) | Phase (deg) |
| FB 11 | $(A_1, \Phi_1)$ | 0.5 | −180-β | 0.5 | 0 |
| FB 12 | $(A_2, \Phi_2)$ | 1 | −85-β | 1 | −85 |
| FB 13 | $(A_3, \Phi_3)$ | 0.5 | 0-β | 0.5 | −180 |
| FB 14 | $(A5, \Phi_5)$ | 0.08 | +110-β | 0 | NA |
| FB 21 | $(A4, \Phi_4)$ | 0 | NA | 0.08 | +110-β |
| FB 22 | $(A1, \Phi_1)$ | 0.5 | −180 | 0.5 | 0-β |
| FB 23 | $(A2, \Phi_2)$ | 1 | −85 | 1 | −85-β |
| FB 24 | $(A3, \Phi_3)$ | 0.5 | 0 | 0.5 | −180-β |
| HB 1 | $(A1, \Phi_1)$ | 0.5 | −180 | 0.5 | 0-β |
| HB 2 | $(A2, \Phi_2)$ | 1 | −85 | 1 | −85-β |
| HB 3 | $(A3, \Phi_3)$ | 0.5 | 0 | 0.5 | −180-β |
| HB 4 | $(A1, \Phi_1)$ | 0.5 | −180-β | 0.5 | 0 |
| HB 5 | $(A2, \Phi_2)$ | 1 | −85-β | 1 | −85 |
| HB 6 | $(A3, \Phi_3)$ | 0.5 | 0-β | 0.5 | −180 |

Figure 17:
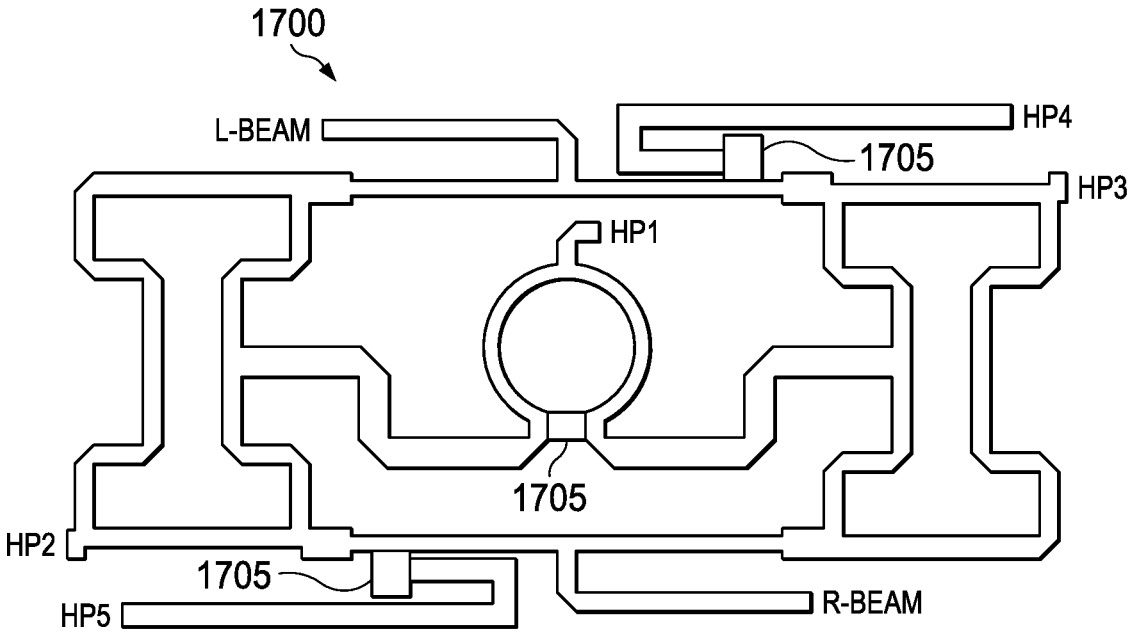
FIG. 17 illustrates a diagram of an embodiment microstrip layout of an 3-column azimuth beam forming network (ABFN)
Figure 18:
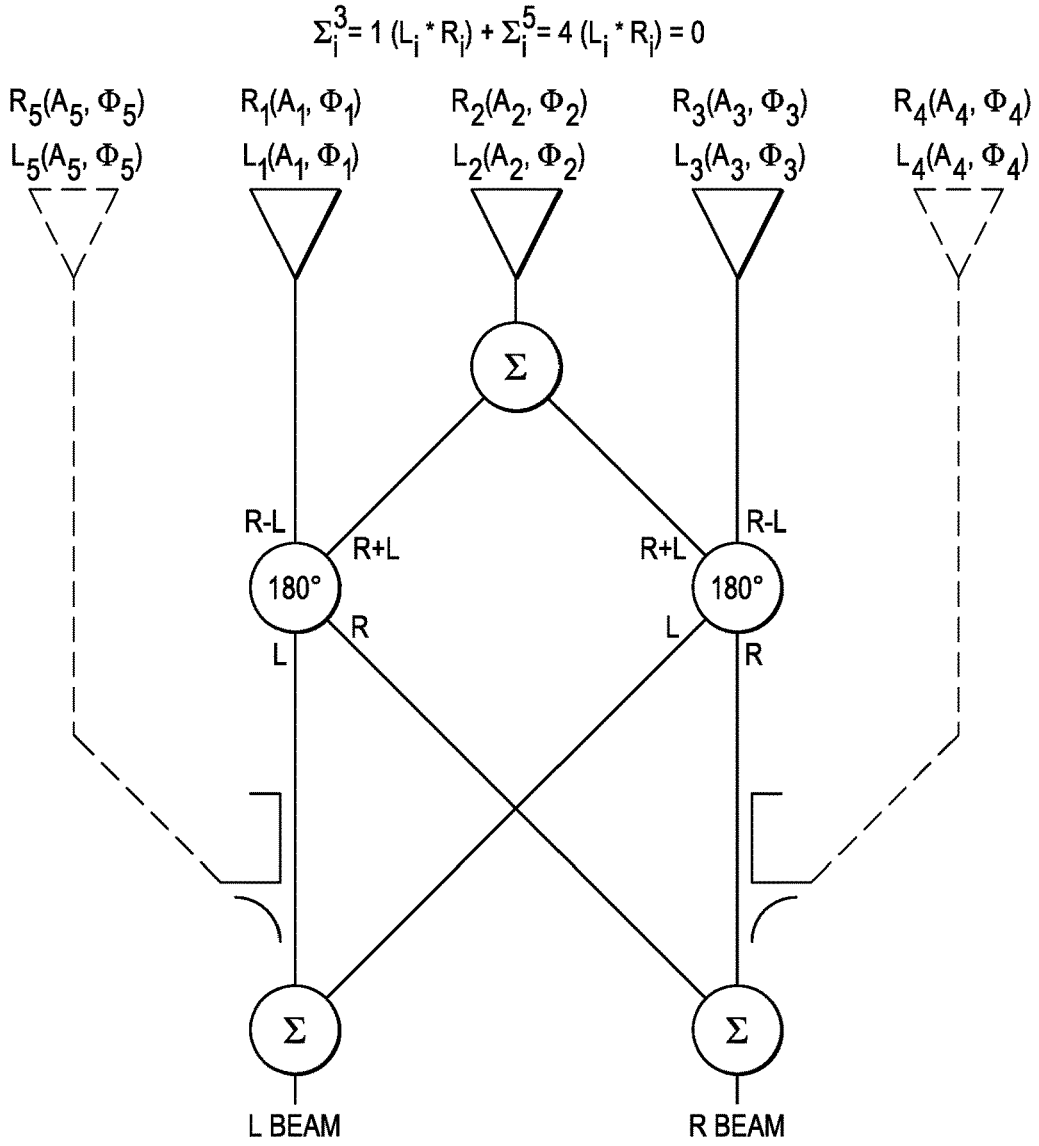
FIG. 18 illustrates a signal flow diagram of the azimuth beam forming network (ABFN)

FIG. 17 illustrates an embodiment microstrip layout of an ABFN 1700. As shown, the ABFN 1700 includes a plurality of resistors 1705, as well as a five antenna ports (AP1, AP2, AP3, AP4, and AP5), a left beam port (L-Beam), and a right beam port (R-Beam). FIG. 18 illustrates an embodiment schematic and signal flow of the ABFN.

Figure 19:
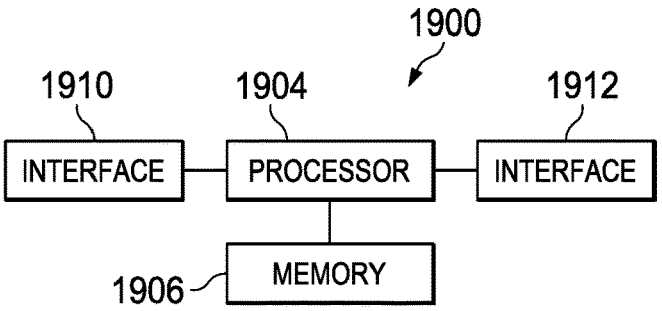
FIG. 19 illustrates a block diagram of an embodiment manufacturing device.

FIG. 19 illustrates a block diagram of an embodiment manufacturing device 1900, which may be used to perform one or more aspects of this disclosure. The manufacturing device 1900 includes a processor 1904, a memory 1906, and a plurality of interfaces 1910-1912, which may (or may not) be arranged as shown in FIG. 19. The processor 1904 may be any component capable of performing computations and/or other processing related tasks, and the memory 1906 may be any component capable of storing programming and/or instructions for the processor 1904. The interfaces 1910-1912 may be any component or collection of components that allows the device 1900 to communicate control instructions to other devices, as may be common in a factory setting.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed:

1. A probe-fed patch radiating element comprising:

a first printed circuit board (PCB), wherein a plurality of microstrip feed-lines are printed on the first PCB;

a second PCB, wherein a plurality of fan-shaped probes are printed on the second PCB;

an antenna reflector positioned in-between the first PCB and the second PCB;

a plurality of feed wires extending through the antenna reflector, the plurality of feed wires conductively coupling the microstrip feed-lines to the fan-shaped probes;

a radiating patch adapted to radiate during emission of a wireless signal; and one or more non-conductive spacers positioned in-between the radiating patch and the second PCB such that the radiating patch is electromagnetically coupled to, but not in direct physical contact with, the fan-shaped probes, the fan-shaped probes adapted to electromagnetically feed a radio frequency (RF) signal to the radiating patch that causes the radiating patch to radiate during emission of the wireless signal.

2. The probe-fed patch radiating element of claim 1, wherein the fan-shaped probes have a fixed length.

3. The probe-fed patch radiating element of claim 2, wherein a width of each of the fan-shaped probes increases across the fixed length.

4. The probe-fed patch radiating element of claim 1, wherein each of the fan-shaped probes have a substantially identical shape.

5. The probe-fed patch radiating element of claim 1, wherein each of the fan-shaped probes have substantially identical dimensions.

6. The probe-fed patch radiating element of claim 1, wherein the fan-shaped probes extend inwardly towards a center of the second PCB.

7. The probe-fed patch radiating element of claim 6, and wherein a width of each of the fan-shaped probes gradually increases as the fan-shaped probe extends inwardly towards the center of the second PCB.

8. A probe-fed patch radiating element comprising:

a first printed circuit board (PCB), wherein a plurality of microstrip feed-lines are printed on the first PCB;

a second PCB, wherein a plurality of fan-shaped probes are printed on the second PCB;

an antenna reflector positioned in-between the first PCB and the second PCB;

a plurality of feed wires extending through the antenna reflector, the plurality of feed wires conductively coupling the microstrip feed-lines to the fan-shaped probes; and a radiating patch adapted to radiate during emission of a wireless signal, the fan-shaped probes adapted to electromagnetically feed a radio frequency (RF) signal to the radiating patch that causes the radiating patch to radiate during emission of the wireless signal.

9. The probe-fed patch radiating element of claim 8, wherein the fan-shaped probes have a fixed length.

10. The probe-fed patch radiating element of claim 9, wherein a width of each of the fan-shaped probes increases across the fixed length.

11. The probe-fed patch radiating element of claim 8, wherein each of the fan-shaped probes have a substantially identical shape.

12. The probe-fed patch radiating element of claim 8, wherein each of the fan-shaped probes have substantially identical dimensions.

13. The probe-fed patch radiating element of claim 8, wherein the fan-shaped probes extend inwardly towards a center of the second PCB.

14. The probe-fed patch radiating element of claim 13, and wherein a width of each of the fan-shaped probes gradually increases as the fan-shaped probe extends inwardly towards the center of the second PCB.

15. A probe-fed patch radiating element comprising:

a first printed circuit board (PCB), wherein a plurality of microstrip feed-lines are printed on the first PCB;

a second PCB, wherein a plurality of fan-shaped probes are printed on the second PCB;

an antenna reflector positioned in-between the first PCB and the second PCB;

a plurality of feed wires extending through the antenna reflector, the plurality of feed wires conductively coupling the microstrip feed-lines to the fan-shaped probes;

a radiating patch adapted to radiate during emission of a wireless signal; and one or more non-conductive spacers positioned in-between the radiating patch and the second PCB such that the radiating patch is electromagnetically coupled to, but not in direct physical contact with, the fan-shaped probes.

16. The probe-fed patch radiating element of claim 15, wherein the fan-shaped probes have a fixed length.

17. The probe-fed patch radiating element of claim 16, wherein a width of each of the fan-shaped probes increases across the fixed length.

18. The probe-fed patch radiating element of claim 15, wherein each of the fan-shaped probes have a substantially identical shape.

19. The probe-fed patch radiating element of claim 15, wherein each of the fan-shaped probes have substantially identical dimensions.

20. The probe-fed patch radiating element of claim 15, wherein the fan-shaped probes extend inwardly towards a center of the second PCB.

21. The probe-fed patch radiating element of claim 20, and wherein a width of each of the fan-shaped probes gradually increases as the fan-shaped probe extends inwardly towards the center of the second PCB.

* * * * *